US008451513B2

(12) United States Patent
Wong et al.

(10) Patent No.: US 8,451,513 B2
(45) **Date of Patent: *May 28, 2013**

(54) IN TRAY MEDIA SENSING

(75) Inventors: Howard G. Wong, Portland, OR (US); Bruce A. Axten, Camas, WA (US); Steven H. Walker, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/562,964

(22) Filed: Jul. 31, 2012

(65) Prior Publication Data

US 2012/0293846 A1 Nov. 22, 2012

Related U.S. Application Data

(62) Division of application No. 12/245,359, filed on Oct. 3, 2008, now Pat. No. 8,259,367.

(60) Provisional application No. 61/035,734, filed on Mar. 11, 2008.

(51) Int. Cl.
*H04N 1/04* (2006.01)

(52) U.S. Cl.
USPC ..... 358/474; 358/497; 399/367; 271/3.14

(58) Field of Classification Search
USPC ..... 358/497, 496, 474, 501, 505, 449, 358/448, 451, 486, 488, 1.13, 1, 16; 399/374, 399/373, 367; 271/227, 186, 3.14, 3.01
See application file for complete search history.

(56) References Cited

U.S. PATENT DOCUMENTS

| | | | | |
|---|---|---|---|---|
| 5,110,106 | A * | 5/1992 | Matsumura et al. | 271/9.06 |
| 5,198,853 | A * | 3/1993 | Ichihara et al. | 399/16 |
| 5,483,889 | A * | 1/1996 | Hoberock et al. | 101/232 |
| 6,598,795 | B1 * | 7/2003 | Prenn | 235/462.01 |
| 6,619,656 | B2 * | 9/2003 | Guddanti et al. | 271/171 |
| 7,871,072 | B2 * | 1/2011 | Rowe et al. | 271/234 |

* cited by examiner

*Primary Examiner* — Negussie Worku
(74) *Attorney, Agent, or Firm* — Erik Anderson

(57) ABSTRACT

A method and apparatus align an adjuster with an edge of media supported by a tray. The adjuster is operably coupled to a gauge that moves in response to movement of the adjuster. A sensor senses the gauge to detect a dimension of the media while the media is supported by the tray.

18 Claims, 8 Drawing Sheets

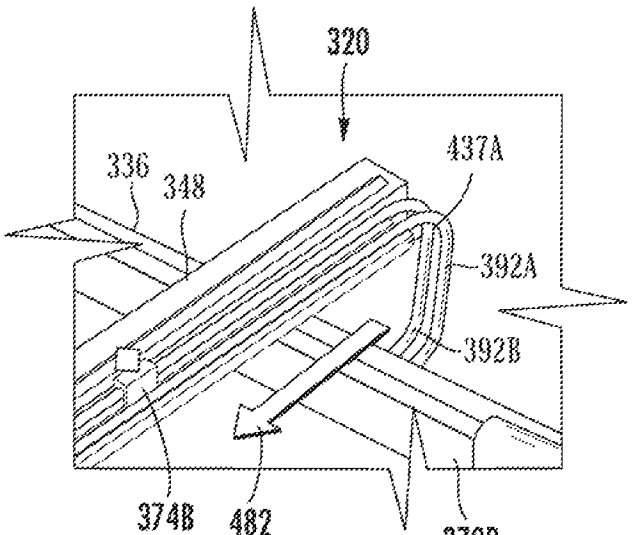
FIG. 11
FIG. 12
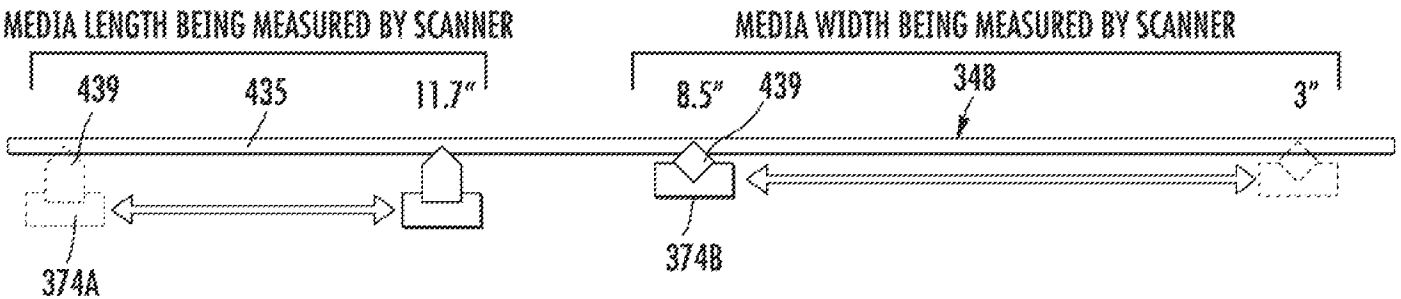
FIG. 13

IN TRAY MEDIA SENSING

CROSS-REFERENCE TO RELATED APPLICATIONS

This is a divisional patent application of U.S. patent application Ser. No. 12/245,359, filed Oct. 3, 2008 now U.S. Pat. No. 8,259,367, which claims the benefit of U.S. provisional patent application Ser. No. 61/035,734, filed Mar. 11, 2008.

BACKGROUND

Many printers, scanners, folders, staplers, and other media handling devices accommodate differently dimensioned media. Present mechanisms used to detect the dimensions of media may be complex, unreliable or expensive.

BRIEF DESCRIPTION OF THE DRAWINGS

FIG. 11 is an enlarged perspective view of the system of FIG. 6 illustrating movement of a first gauge in response to movement of a first adjuster from the first position shown in FIG. 9 to second position shown in FIG. 10 according to an example embodiment.

FIG. 12 is an enlarged perspective view of the system of FIG. 6 illustrating movement of a second gauge in response to movement of a second adjuster from the first position shown in FIG. 9 to second position shown in FIG. 10 according to an example embodiment.

FIG. 13 is a top plan view of a portion of the system of FIG. 6 illustrating movement of gauges along an image sensor according to an example embodiment.

DETAILED DESCRIPTION OF THE EXAMPLE EMBODIMENTS

Figure 1:
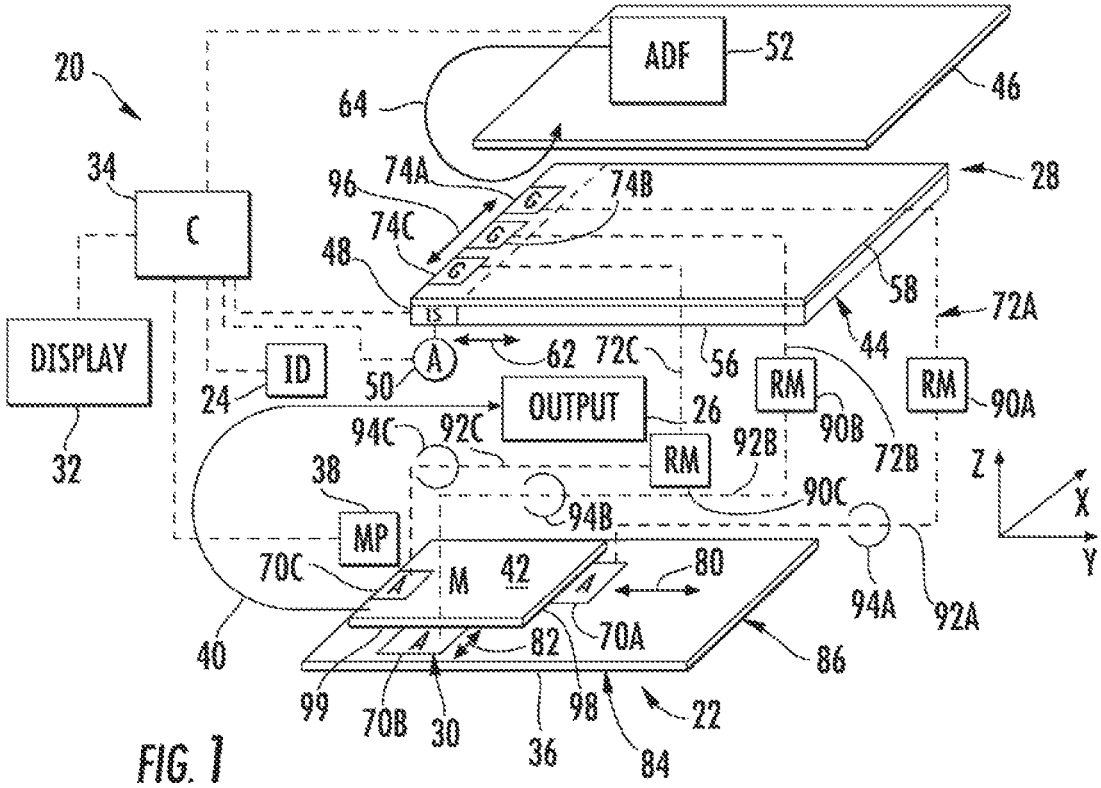
FIG. 1 is a schematic illustration of a media handling system according to an example embodiment.

FIG. 1 dramatically illustrates media interaction system 20 according to one example embodiment. Media interaction system 20 is configured to interact with media in one or more fashions such as printing upon media, scanning or sensing images (graphics and data) from media, folding, stapling or collating sheets of media. As will be described hereafter, media interaction system 20 includes in tray media sensing which facilitates detection of media dimensions in a less complex, reliable and inexpensive manner.

As shown by FIG. 1, media interaction system 20 includes a media feed system 22, interaction device 24, output 26, image sensing or scanning system 28, in tray media sensing system 30, display 32 and controller 34. Media feed system 22 comprises that part of system 20 configured to feed or supply media to interaction device 24. Media feed system 22 includes media tray 36, media pick device 38 and media feed path 40. Media tray 36 comprises a bin, tray or other device configured to contain, support and store media prior to the media being transported along media feed path 40 to interaction device 24. Although media tray 36 is illustrated as a substantially horizontal platform upon which sheets of media rest prior to being individually picked by media pick device 38, in other embodiments, tray 36 may be inclined. Although tray 36 is illustrated as being located below output 26 and scanning system 28, in other embodiments, the relative positioning of tray 36 with respect to output 26 and scanning system 28 may be altered.

Media pick device 38 comprises a device configured to contact and frictionally engage a surface of a sheet of media, such as sheet 42, and to pick and extract the sheet from a stack and move the sheet into media feed path 40. In particular embodiments, tray 36 and media pick device 38 may alternatively be configured to support a single sheet of media, rather than a stack of media, wherein media pick device 38 moves a single sheet into media feed path 40. In other embodiments, other mechanisms may be used in lieu of media pick device 38 for initiating movement of a sheet into media feed path 40.

Media feed path 40, schematically shown, moves sheets of media from tray 36 to media interaction device 24. Media feed path 40 may include one or more rollers, belts, conveyors or stationary guides configured to direct or move sheets of media from tray 36 to interaction device 24. For example, in one embodiment, media feed path 40 may include a series of rotationally driven rollers opposite to stationary guides or idler rollers. Although media feed path 40 is illustrated as having an arcuate or curved shape, in other embodiments, media feed path 40 may have a variety of other configurations such as serpentine paths, angled paths, straight paths, or combinations thereof.

Media interaction device 24 comprises a device configured to interact with sheets of media supplied from tray 36. In one embodiment, media interaction device 24 comprises a print device configured to print or otherwise form an image upon one or both faces of a sheet of media. For purposes of this disclosure, the term "image" shall include, not limited to, graphics, text, photos and the like. Examples of such print devices include, not limited to, drop-on-demand inkjet print devices and dry liquid toner electrostatic printing devices. Examples of drop-on-demand inkjet print devices include page-wide-array inkjet print devices or scanning devices wherein one or more print heads are scanned or transported across a sheet of media while printing upon the sheet of media. In other embodiments, media interaction device 24 is configured to interact with sheets of media such as a device configured to sever, fold, collate or staple sheets of media. In particular embodiments, media interaction device 24 performs multiple combinations of such interaction functions. As will be described hereafter, such interactions may vary depending upon the dimensions of the sheets being interact upon.

Output 26 comprises a device configured to receive sheets of media after such sheets of media have been interacted upon. In one embodiment, output 26 comprises an output bin, tray or a storage container providing a person with access to the completed sheets. In another embodiment, output 26 may comprise a mechanism configured to further transport such sheets to an accessory for additional interaction or processing or back to media feed path 40 for further secondary interaction with media interaction device 24, such as duplex printing. In other embodiments, output 26 may be omitted.

Scanning system 28 comprises an arrangement of components configured to sense existing images upon sheets of media and to transmit signals representing the sense images to controller 34. In the particular example illustrated, scanning system 28 is configured to provide two scanning functions: a flatbed scanning function in which sheets, books, are other articles are placed upon a bed an image sensor is moved across the bed or an automatic scanning function in which sheets are fed across a stationary image sensor. Scanning system 28 includes scanning bed or tub 44, scanning lid 46, image sensor 48, actuator 50 and automatic document feeder 52.

Scanning tub 44 comprises a structure configured to support a sheet or other article as image sensor 48 is moved across the sheet or article being scanned. Scanning tub 44 includes a base 56 and a transparent platen 58. Base 56 supports platen 58. In the particular embodiment illustrated, base 56 further supports and guides movement of image sensor 48 across platen 58. Platen 58 comprises a panel of transparent material, such as glass, through which image sensor 48 senses image upon a sheet or article facing platen 58.

Scanning lid 46 comprises a structure configured to cover scanning tub 44. In one embodiment, lid 46 is conveyed to reflect light supplied by image sensor 48 back towards image sensor 48 through platen 58. In another embodiment, lid 46 may include a light source configure direct light through platen 58, facilitating the scanning of transparencies. Lid 46 further inhibits stray tight from being sensed by image sensor 48.

Image sensor 48 comprises a device configured to sense images upon the surfaces facing platen 58. In the particular embodiment illustrated, image sensor 48 comprises an optical sensor configured to emit light through platen 58, wherein the light reflected off of sheets or articles upon platen 58 is reflected back to image sensor 48 which senses the reflected light. In the example illustrated, image sensor 48 comprises an elongate scan bar extending across platen 58 in the X-axis direction having one or more rows of sensing elements. In one embodiment, image sensor 48 comprises one or more rows of charge coupled devices which produce electrical signals that vary based upon the sensed reflected light. In one embodiment, image sensor 48 comprises one or more sensing elements configured to sense distinct colors of light reflected from the surface facing platen 58. In other embodiments, image sensor 48 may comprise other sensing mechanisms configured to sense images upon surfaces facing platen 58.

Actuator 50 comprises a device configured to move image sensor 48 at least partially across platen 58 in the Y-axis direction as indicated by arrows 62. Actuator 50 further moves or returns image sensor 48 to at least one parked position. In one embodiment, the parked position is a location or region beneath platen 58 opposite to where sheets of media are moved across by automatic document feeder 52. Movement of image sensor 48 is guided by rails, tracks, rods or other guiding and supporting structures associated with base 56 or other structures of a system 20. In one embodiment, actuator 50 may comprise a motor and a rack and pinion arrangement promoting image sensor 48 across platen 58. In other embodiments, actuator 50 may comprise a motor for driving a belt, wherein image sensor 48 is attached to the belt and is movably supported beneath platen 58 by a rod, track, tongue and groove arrangement or other bearing mechanism. In yet another embodiment, actuator 50 may comprise a motor configured to rotate a worm screw extending through a nut secured to image sensor 48.

Automatic document feeder 52 comprises a device configured to pick individual sheets to be scanned from a stack of such sheets and to move the picked or selected sheet relative to and across image sensor 48 white image sensor 48 senses or scans images from a surface of the sheet. In the example illustrated, automatic document feeder 52 is supported by lid 46 and includes a media pick device, such as a pick roller or tire (not shown), configured to contact a top sheet of a stack of sheets and to move the picked sheet along a media feed path 64 (schematically illustrated) and across image sensor 48. Media feed path 64 may be provided by one or more stationary guide structures, driven rollers, either rollers, belts, conveyors and the like. In the example illustrated, media feed path 64 of automatic document feeder 52 returns sensed or scanned sheets to an output surface or tray provided on top of lid 46. In other embodiments, a scanned sheet may be transported to other locations.

Although scanning system 28 is illustrated as providing both a flatbed scanning function and an automatic document scanning function, in other embodiments, scanning system 28 may alternatively provide only one of such functions. For example, in another embodiment, automatic document feeder 52 and its media feed path 64 may be omitted where scanning system 28 just provides a flatbed scanning function. In another embodiment, actuator 50, platen 58 and those portions of base 56 which movably support or guide image sensor 48 may be omitted where scanning system 28 just provides an automatic document scanning function. In such an alternative embodiment, image sensor 48 may be stationary (in the parked location) at substantially all times, wherein only those portions of platen 58 opposite to image sensor 48 are transparent. In such embodiments, a substantial portion of platen 58 and base 56 may even be omitted.

In tray media sensing system 30 is configured to sense or detect one or more dimensions of media while such media supported by tray 36 and prior to any movement of such media from tray 36 or along media feed path 40. System 30 includes sliders, markers or adjusters 70A, 70B, 70C (collectively referred to as adjusters 70), couplers 72A, 72B, 72C (collectively referred to as couplers 72), gauges 74A, 74B, 74C (collectively referred to as gauges 74) and image sensor 48. Adjusters 70 comprise structures configured to be selectively positioned at different positions along tray 36 to indicate the edges, tops or dimensions of the media 42. In other embodiments, adjusters 70 may alternatively be configured to be selectively positioned at different positions along tray 36 corresponding to those portions of media 42 that are to be interacted upon. For example, if only the bottom half of one or more sheets 42 are to be printed upon, hole punched or the like, adjuster 70 may alternatively be positioned at a midpoint of sheets 42. In one embodiment, adjusters 70A, 70B comprise linear or straight edges configured to be aligned with edges of sheets 42 of media. In another embodiment, each of adjusters 70A, 70B may terminate at a point configured to point to an edge of sheets 42. Adjuster 70C is configured to be positioned along a top surface rather than a side surface or edge of media 42. In the particular embodiment illustrated, adjusters 70 are configured to be manually positioned by a person that desired locations along tray 36 and media 42. In other embodiments, other mechanical mechanisms may be used to reposition adjusters 70 at desired locations along tray 36 such as in alignment with or proximate to tops or edges of sheets 42 of media.

According to one embodiment, adjusters 70 are each movably supported and guided along tray 36 by tray 36. In one embodiment, adjusters 70 extend above a top of tray 36 and slidably and linearly move along tracks, rails, rods or other guides. In other embodiments, adjusters 70 may be movably supported by other bearing or guiding structures. In the particular example illustrated, adjuster 70A is configured to move in the Y-axis direction as indicated by arrows 80 which is substantially parallel to a longitudinal axis (the longer dimension) of tray 36. Adjuster 70B is configured to move in the X-axis direction indicated by arrows 82 which is substantially parallel to a transverse axis (the shorter dimension) of tray 36. Adjuster 70C is configured to move in the Z-axis to be positioned along a top of a sheet for stack height or sheet count detection. Adjuster 70A is located at a location along tray 36 so as to extend opposite to it the largest range of sheets 42 having different transverse widths that may be placed upon tray 36. In one embodiment, adjuster 70A is located at a central midpoint of tray 36 along the X-axis. Adjuster 70B is located at a location along tray 36 so as to extend opposite to a largest range of sheets 42 having different longitudinal lengths that may be placed upon tray 36. In one embodiment, adjuster 70B is located at a central midpoint of tray 36 along the Y-axis. In other embodiments, system 30 may include a plurality of spaced adjusters 70A and a plurality of spaced adjusters 70B to facilitate easier alignment or positioning of one or more of the plurality of adjusters with one or more sheets 42 of media upon tray 36. In such an embodiment, the plurality of adjusters 70A or the plurality of adjusters 70B may be physically connected or coupled to one another such a movement of one adjuster causes movement of the remaining adjusters along the X-axis (adjusters 70A) or along the Y-axis (adjusters 70B). In still other embodiments, one or more of adjusters 70A, 70B, 70C may alternatively extend substantially across an entire associated dimension of tray 36. In one embodiment, adjuster 70A may be slidably supported along the edge 84 of tray 36 while extending transversely across tray 36 in X-axis direction above tray 36. Likewise, adjuster 70B may be slidably supported along edge 86 in the Y-axis direction while projecting above tray 36. Adjuster 70C may slidably extend along a post, side wall or other vertical structure extending above tray 36.

Couplers 72 comprise mechanisms operably coupling adjusters 70 to gauges 74 such that movement of adjusters 70 also results in movement of gauges 74. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

In the example illustrated, coupler 72A couples adjuster 70A to gauge 74A such that movement of adjuster 70A also results in movement of gauge 74A. Likewise, coupler 72B couples adjuster 70B to gauge 74B such that movement of adjuster 70B also results in movement of gauge 74B. Coupler 72C couples adjuster 70C to gauge 74C such that movement of adjuster 70C also results in movement of gauge 74C. In the example illustrated, each of couplers 72A, 72B, 72C include reduction mechanisms 90A, 90B, 90C (collectively referred to as reduction mechanisms 90), motion transmitters 92A, 92B, 92C (collectively referred to as motion transmitters 92) and guides 94A, 94B, 94C (collectively referred to as guides 94).

Reduction mechanisms 90 comprise arrangements or mechanisms located between adjusters 70 and gauges 74 that are configured to proportionately reduce the distance moved by gauges 70 in response to movement of adjusters 70. In other words, reduction mechanisms 90 result in gauges 74 proportionally moving relative to adjusters 70 at a rate of less than one. In one embodiment, reduction mechanisms 90 comprise a series of pins and linkages coupled between adjusters 70 and gauges 74. In one embodiment, reduction mechanisms 90 are coupled between adjusters 70 and motion transmitters 92. In another embodiment, reduction mechanisms 90 are coupled between gauges 74 and motion transmitters 92. In yet another embodiment, reduction mechanisms 90 are coupled between segments of motion transmitters 92. Because reduction mechanisms 90 proportionally reduce the extent to which gauges 74 move in response to movement of adjuster 70, gauges 74 may be more compactly arranged along platten 58 so that image sensor 48 may satisfactorily capture or sense positioning of both of gauges 74 with little or reduced movement of image sensor 48. In other embodiments, reduction mechanisms 90 may be omitted, wherein gauges 74 move a distance substantially identical to the distance moved by adjusters 70.

Flexible motion transmitters 92 comprise elongate flexible members operably coupled between adjusters 70 and gauges 74 that are configured to transmit movement or motion white still being flexible. In particular, each of motion transmitters 92 is substantially incompressible or unstretchable along its axial centerline, yet is a flexible, bendable or deformable in directions non-parallel to its axial centerline without damage or degradation. Because each of motion transmitters 92 is flexible, each of motion transmitters 92 may extend along a non-linear path, such as long a band, a curve comment angled or a serpentine path between an associated adjuster 70 and an associated gauge 74. As a result, motion transmitters 92 may extend in a variety of different travel paths, increasing freedom and flexibility in the architecture of system 20. Because motion transmitters 92 are flexible, adjusters 70 and gauges 74 may be provided at distinct vertical levels or positions along the Z-axis of system 20. For example, adjuster 70 is located below base 56 while gauges 74 are generally above base 56. In other embodiments, adjusters 70 and gauges 74 may be at other distinct location through the use of flexible couplers 72.

In one embodiment, each of couplers 72 includes a flexible pushrod through which motion is transferred. According to one embodiment, each flexible pushrod may be formed from a dual strand bronzed steel cable. In such an embodiment, the flexible pushrod of coupler 72 has a diameter of $1/16^{th}$ of an inch. With such an embodiment form having the noted dimensions, the pushrod is sufficiently strong to transmit force and movement from adjusters 70 to gauges 74. In other embodiments, depending upon the expected forces, amount of guidance and support provided for coupler 72, and the length or distance over which motion must be transferred, the one or more materials chosen for couplers 72 and the dimensions of each of couplers 72 may be varied.

Guides 94 (schematically illustrated) comprise channels, bores, tracks or elongate continuous or intermittent structures which direct sliding movement of motion transmitters 92 along a controlled or defined non-linear path. Guides 94 may be formed in the frame or housing (not shown) of system 20 as well as along portions of tray 36 and base 56. For example, in one embodiment, guides 94 may comprise C-shaped channels (continuous or spaced and intermittent) formed along tray 36 and base 56 which surround greater than 180° of a cylindrical and flexible pushrod of motion transmitters 92 to capture and contain the pushrod while permitting a pushrod to slide through the central opening of the C-shaped channel. In other embodiments, such guides 94 may have other configurations.

Gauges 74 comprise structures operably coupled to adjusters 70 and configured to move in response to adjuster 70. Gauges 74 further configured to define points or edges corresponding to dimensions of sheets 42 based upon their positions. Gauges 74 are configured to be sensed by image sensor 48. In one embodiment, gauges 74 project into the optical viewing range of image sensor 48. In the embodiment in which system 20 includes automatic document feeder 52, image sensor 48 may be movable between a first parked positioned in which image sensor 48 senses sheets of media moved across image sensor 48 by automatic document feeder 52 along path 64. In such an embodiment, image sensor 48 may be further movable to a second parked position by actuator 58 in which gauges 74 are within the optical viewing range of image sensor 48. As a result, gauges 74 do not interfere with sensing or scanning of images from sheets being fed by automatic document feeder 52. In embodiments where automatic document feeder 52 is omitted, image sensor 48 may be moved to a single parked position by actuator 50, wherein gauges 74 are within or project into the viewing range of image sensor 48.

In one embodiment, as shown in FIG. 1, gauges 74 move along a single axis or along different but parallel axes in response to movement of gauges 70. In the example illustrated, gauges 74 move along at a single X-axis in the directions indicated by arrows 96. Flexible motion transmitters 92 facilitate positioning and movement of gauges 74 along a single axis or along parallel axes. Because gauges 74 move along a single axis or along parallel axes, gauges 74 may be more closely located with respect to one another and the sensing of the positioning of gauges 74 may be more easily achieved with little or no movement of imaging sensor 48. In example illustrated, the positioning of both the gauges 74 may be detected by image sensor 48 using one or more rows of sensing elements while image sensor 48 is substantially stationary or parked. In other embodiments, gauge 74A, gauge 74B and gauge 74C may alternatively move along distinct non-parallel axes. In such an embodiment, image sensor 48 may be moved to sense the positioning of both of such gauges or additional sensors may be employed to sense the positioning of one or both of gauges 74.

Display 32 comprises a device configured to present information to one or more persons regarding the sensor detected dimensions of sheets 42 of media by the in tray media sensing system 30. Display 32 may also be configured to present instruction and/or choices of options for the user to select based upon the presented dimension information. In one embodiment, display 32 may comprise a display screen. In another embodiment, display 32 may comprise rows of lights, such as rows of light emitting diodes (LEDs) representing different dimensions. This other box, display 32 may comprise an audible display providing sounds or synthesized words communicating the sensed dimensions. In other embodiments, display 32 may be omitted.

Controller 34 comprises one or more processing units configured to generate control signals based at least in part upon signals received from image sensor 48 (or other sensors) which represent the positioning of gauges 74 which correspond to positioning of adjusters 70. As noted above, in particular embodiments, the positioning of adjusters 70 correspond to the dimensions of sheets 42 of media. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), amass storage device, or some other persistent storage. In other embodiments, hard wired circuitry may be used in place of or in combination with software instructions to implement the functions described. For example, controller 92 may be embodied as part of one or more application-specific integrated circuits (ASICs). Unless otherwise specifically noted, the controller is not limited to any specific combination of hardware circuitry and software, nor to any particular source for the instructions executed by the processing unit.

In the particular example illustrated, controller 34 receives signals from image sensor 48 which correspond to dimensions of sheets 42 upon tray 36. Based upon such signals, controller 34 consults a lookup table stored in a memory, applies an algorithm or otherwise determines the actual dimensions of sheets 42 upon tray 36. In one embodiment, controller 34 generates a control signal directing display 32 to present the detected and determined dimensions of sheets 42 to a user. In one embodiment, controller 34 may additionally generate a control signal directing display 32 to provide the user or person with options or instructions based upon such detected dimensions. In one embodiment, controller 34 may also generate control signals which vary or adjust operation of media picked device 38 and/or interaction device 24 based upon the determined mentions of sheets 42 within tray 36. For example, for a given set of sheet dimensions, controller 34 may adjust the speed, torque or compressive force applied by media picked device 38 or media drivers of media path 40. In particular, a certain dimension may indicate that a stiffer media has been loaded upon tray 36 or a particular media type (photo media) has been loaded upon tray 36. Controller 34 may adjust operational parameters to best accommodate such media.

Based upon the determined media size or dimensions, controller 34 may also vary the operation of interaction device 24. For example, in embodiments where interaction device 24 comprises a print device, controller 34 may adjust the extent (surface area) to which interaction device 24 prints upon sheet 42. The resolution, quality, density or type of ink or toner being applied may also be determined or controlled based upon the determined dimensions of sheet 42 or media quality generally associate it with a particular media size.

Figure 2:
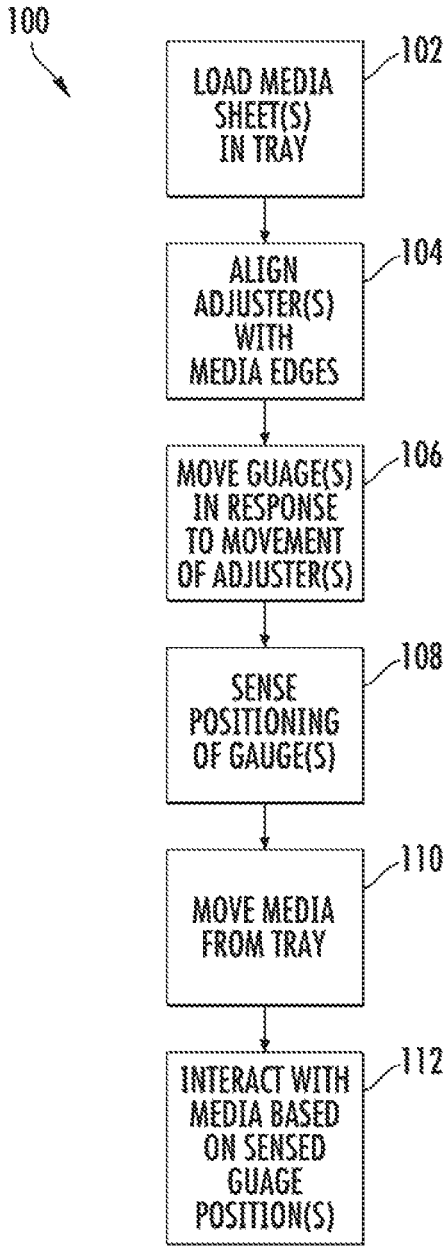
FIG. 2 is a flow diagram of an example method for in tray media sensing according to an example embodiment.

FIG. 2 is a flow diagram illustrating an example method 100 that may be performed by system 20. As indicated in step 102, sheets 42 of media are initially loaded onto tray 36. Such loading may be manually by a person or may be performed mechanically by another media handling device. Sheets 42 may be loaded as part of a stack or as a single sheet and may have a variety of different sizes or dimensions.

As indicated by step 104, adjusters 70 are aligned with media edges. In one embodiment, a person may move or slide adjusters 70A until adjusters 70A either abuts edge 98 (shown in FIG. 1) of sheets 42 or extends at a position along the Y-axis in alignment with edge 98 but to a side of sheet 42 in the X-axis direction. Likewise, in one embodiment, a person may move or slide adjusters 70B until adjusters 70B either abuts edge 99 (shown in FIG. 1) of sheets 42 or extends at a position along the X-axis in alignment with edge 99 but to a side of sheet 42 in the Y-axis direction. As indicated in step 106, such movement of adjusters 70 moves gauges 74. In particular, as noted above, motion or movement of adjusters 70 is transmitted via motion transmitters 92. Due to reduction mechanisms 90, gauges 74 move proportionally and at a fraction of the movement of adjusters 70.

As indicated by step 108, controller 34 generates control signals directing image sensor 48 to sense or detect the resulting positions of gauges 74. In the embodiment illustrated, image sensor 48 detects gauges 74 without being moved. In other embodiments, controller 34 may initially generate control signals causing actuator 50 to reposition image sensor 48 so as to sense gauges 74 either concurrently or sequentially. Based upon the sensed positions of gauges 74, controller 34 determines the dimensions (length and width) of sheets 42. As noted above, controller 34 consults a lookup table (including sheet dimensions corresponding to gauge positions) stored in memory, applies an algorithm or otherwise determines the actual dimensions of sheets 42 upon tray 36. Based upon the determined dimensions, controller 34 generates control signals selecting or adjusting operational parameters of media picked device 38, media interaction device 24 or other media contacting or interacting components of system 20.

As indicated by step 110, once the dimensions of sheets 42 has been determined by controller 34, controller 34 generates control signals correcting media picked device 38 and media path 40 to move sheets 42 from tray 36. As indicated by step 112, each sheet moved from tray 36 is interacted upon based upon the sensed gauge positions which correspond to the dimensions of the media.

Although system 20 and method 100 utilize a pair of adjusters 74 being aligned with respect to a pair of noncontiguous edges of sheets 42 to facilitate determination of a pair of orthogonal dimensions of sheet 42, in other embodiments, system 20 and method 100 may alternatively utilize a single adjuster 70 and a single gauge 74 for determining a single dimension of sheets 42. In such an embodiment, the other dimension may not be needed. Alternatively, the undetermined dimension may be presumed by controller 34 based upon the determined dimension. For example, if controller 34 determines that sheets 40 to have a longitudinal length of 11 inches, controller 34 may, following instructions contained in a memory, presume that sheet 42 has an associated width of 8.5 inches and generate control signals based upon both the determined length and presumed width.

Figure 3:
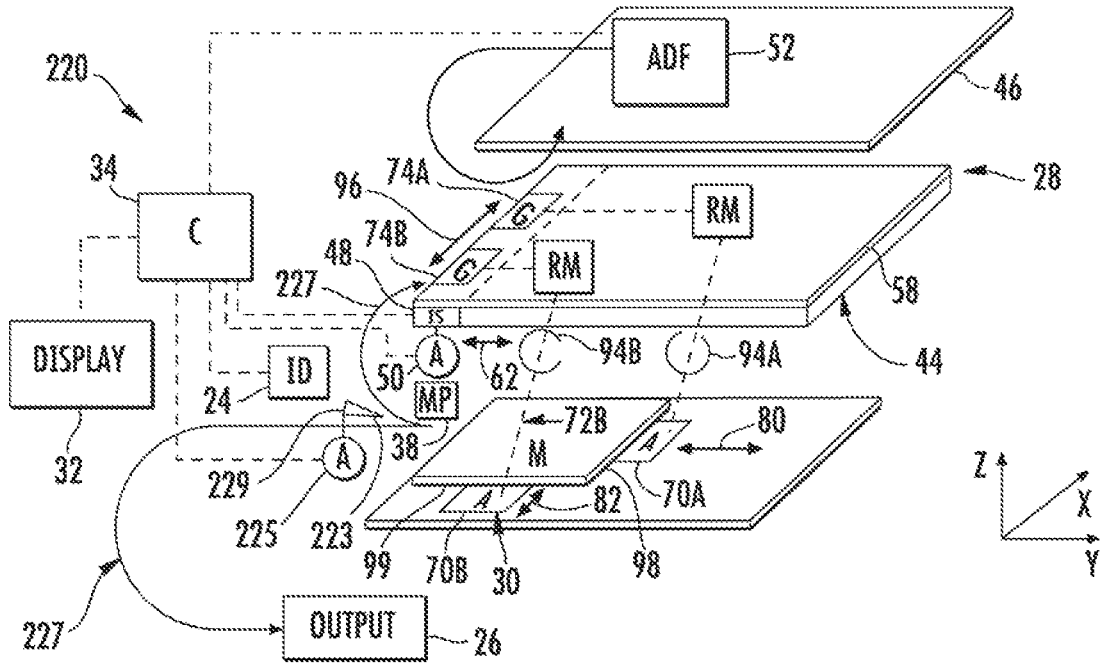
FIG. 3 is a schematic illustration of another embodiment of the media handling system of FIG. 1 according to an example embodiment.

FIG. 3 schematically illustrates media interaction system 220, another embodiment of media interaction system 20. Media interaction system 220 is similar to media interaction system 20 except that media interaction system 220 additionally includes media diverter 223, actuator 225 and media path 227. Those remaining elements or components of system 220 which correspond to elements of system 20 are numbered similarly. Overall, system 220 offers the same benefits as system 20 except that system 220 additionally provides the option of selectively directing sheets 42 of media from tray 36 across image sensor 48 for scanning images upon such sheets from tray 36 using diverter 223, after 225 and a media path 227 in conjunction with additional computer readable program instructions are control instructions in a memory readable by controller 34.

Diverter 223 comprise a member configured to move between a first position in which sheets 42 being picked by media picked device 38 are directed to output 26 and a second position in which sheets 42 being picked by media pick device 38 are directed to media path 227. In the example illustrated, diverter 223 comprises a triangular shaped member configured to pivot about axis 229 between the first position and the second position. In other embodiments, diverter 223 a slide or otherwise move between the first position in the second position.

Actuator 225 comprises a device configured to selectively move diverter 223 between the first position and the second position. In one embodiment, actuator 225 may comprise a motor, electric solenoid, hydraulic or pneumatic cylinder assembly and associated cam or linkage and the like configured to move or rotate diverter 223 between the first position and the second position. Actuator 225 moves diverter 223 in response to control signals from controller 34.

Media path 227 may include one or more rollers, belts, conveyors or stationary guiding structures configured to direct or move sheets of media from tray 36 to and across platen 58 at least aver image sensing device 48. For example, in one embodiment, media feed path 227 may include a series of rotationally driven rollers opposite to stationary guides or idler rollers. Although media feed path 227 is illustrated as having an arcuate or curved shape, in other embodiments, media feed path 40 may have a variety of other configurations such as serpentine paths, angled paths or combinations thereof. Although tray 36 is illustrated as being vertically located between output 26 and platen 58, in other embodiments, tray 36 may be located below both output 26 and platen 58 as seen in FIG. 1.

In operation, system 220 operates according to method 100 described above with respect to FIG. 2 except that prior to moving media from tray 36 in step 110, controller 34 generates control signals directing actuator 225 to appropriately position diverter 223 in either the first position or the second position based upon commands or instructions received from a user via an input such as a keyboard, touch screen, mouse or other device. In this manner, the person may select sheets within tray 36 for either being interacted upon by interaction device 24 or for being scanned by image sensor 48 of scanning system 28. In such sheets 42 are to move along media path 227 and across image sensor 48, controller 34 utilizes a determined dimension or dimensions of sheets 42 to adjust the operational parameters of image sensor 48. For example, in one embodiment, the time at which sensor 48 captures data or images from sheets 42 may be varied depending upon the actual detected dimensions of such sheets 42. In such an embodiment, sheets may be scanned automatically without the use of automatic document feeder 52, which may be omitted.

FIGS. 4-14 illustrate media interaction system 320, another embodiment of media interaction system 20. As shown by FIGS. 4-6A, media interaction system 320 generally includes media feed system 322, interaction device 324, output 326, image sensing or scanning system 328, in tray media sensing system 330 (shown in FIGS. 5, 6 and 6A), display 332 (shown in FIG. 4) and controller 334 (schematically shown in FIG. 5). Media feed system 322 comprises that part of system 320 configured to feed or supply media to interaction device 324. Media feed system 322 includes media tray 336, media pick device 38 (shown and described with respect to FIG. 1) and a media feed path 40 (shown and described with respect to FIG. 1). Media tray 336 comprises a bin, tray or other device configured to contain, support and store media prior to the media being transported along media feed path 40 to interaction device 324. Although media tray 336 is illustrated as a substantially horizontal platform upon which sheets of media rest prior to being individually picked by media pick device 38, in other embodiments, tray 336 may be inclined. Although tray 336 is illustrated as being located below output 326 and scanning system 328, in other embodiments, the relative positioning of tray 336 with respect to output 326 and scanning system 328 may be altered.

Media interaction device 324 comprises a device configured to interact with sheets of media supplied from tray 336. In the example illustrated, media interaction device 324 comprises a print device configured to print or otherwise form an image upon one or both faces of a sheet of media. Examples of such print devices include, but are not limited to, drop-on-demand inkjet print devices and dry or liquid toner electrostatic printing devices. Examples of drop-on-demand inkjet print devices include page-wide-array inkjet print devices or scanning print head devices wherein one or more print heads are scanned or transported across a sheet of media while printing upon the sheet of media. In other embodiments, media interaction device 324 may comprise other devices configured to interact with sheets of media such as device configured to sever, fold, collate or staple sheets of media. In particular embodiments, media interaction device 324 performs multiple combinations of such interaction functions. As will be described hereafter, such interactions may vary depending upon the dimensions of the sheets being interact upon.

Output 326 comprise a device configured to receive sheets of media after such sheets of media have been interacted upon. In one embodiment, output 326 comprises an output bin, tray or a storage container providing a person with access to the completed sheets. In another embodiment, output 326 may comprise a mechanism configured to further transport such sheets to an accessory for additional interaction or processing or back to media interaction device 324 for further secondary interaction, such as duplex printing. In other embodiments, output 26 may be omitted.

Scanning system 328 comprises an arrangement of components configured to sense existing images upon sheets of media and to transmit signals representing the sense images to controller 334. In the particular example illustrated, scanning system 328 is configured to provide a flatbed scanning function in which sheets, books, or other articles are placed upon the bed as an image sensor is moved across the bed. In other embodiments, scanning system 328 may additionally include automatic document feeder 52 (shown in FIG. 1). Scanning system 328 includes scanning bed or tub 344, scanning lid 346 (shown in FIG. 4), image sensor 348 (shown in FIG. 5) and actuator 50 (shown and described with respect to FIG. 1).

Scanning tub 344 comprises a structure configured to support a sheet or other article as image sensor 348 is moved across the sheet or article being scanned. Scanning tub 344 includes a base 356 and a transparent platen 358. Base 356 supports platen 358. In the particular embodiment illustrated, base 356 further supports and guides movement of image sensor 348 across platen 358. Platen 358 comprises a panel of transparent material, such as glass, through which image sensor 348 senses an image upon a sheet or article facing the platen 358.

Scanning lid 346 comprises a structure configured to cover scanning tub 344. In one embodiment, lid 346 is configured to reflect light supplied by image sensor 348 back towards image sensor 348 through platen 358. In another embodiment, lid 346 may include a light source configured to direct light through platen 358 to facilitate scanning of transparencies. Lid 346 further inhibits ambient light from being sensed by image sensor 348.

Image sensor 348 comprises a device configured to sense images upon the surface facing the platen 358. In the particular embodiment illustrated, image sensor 348 comprises an optical sensor configured to emit light through platen 358, wherein the light reflected off of sheets or articles upon platen 358 are reflected back to image sensor 348 which senses the reflected light. In the example illustrated, image sensor 348 comprises an elongate bar extending across platen 358 in the X-axis direction having one or more rows of sensing elements. In one embodiment, image sensor 348 comprises one or more rows of charge coupled devices or elements which produce electrical signals that vary based upon the sensed reflected light. In one embodiment, image sensor 348 comprises one or more sensing elements configured to sense distinct colors of light reflected from the surface facing, platen 358. In other embodiments, image sensor 348 may comprise other sensing mechanisms configured to sense images upon surfaces facing platen 58.

Actuator 50 (schematically shown in FIG. 1) moves image sensor 348 at least partially across platen 358 in the Y-axis direction. Actuator 50 further moves or returns image sensor 348 to a parked position. Movement of image sensor 348 is guided by rails, tracks, rods or other guiding and supporting structures (not shown) associated with base 356 or other structures of a system 320.

Figure 6A:
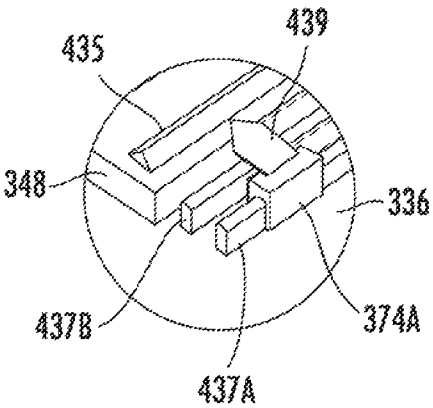
FIG. 6A is an enlarged view of gauges of the system of FIG. 6 taken along line 6A-6A according to an example embodiment.
Figure 6:
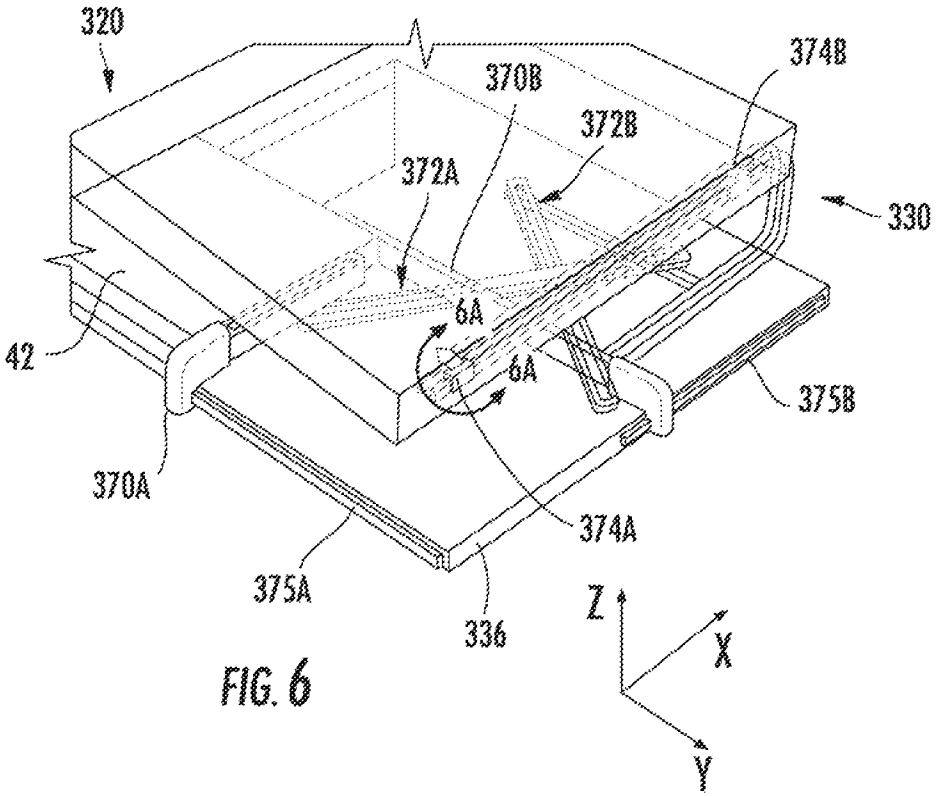
FIG. 6 is a top perspective view of portions of the media handling system of FIG. 4 illustrating couplers of and in tray sensing system according to an example embodiment.
Figure 8:
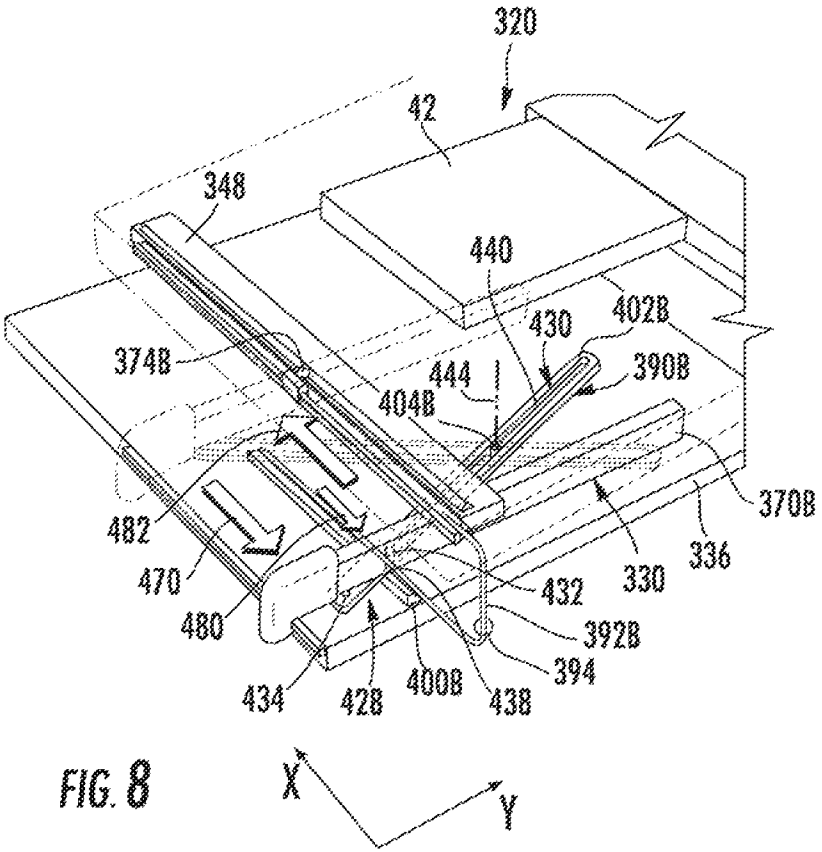
FIG. 8 is a top perspective view of the media handling system of FIG. 6 illustrating two positions of a second adjuster and a second gauge according to an example embodiment.
Figure 7:
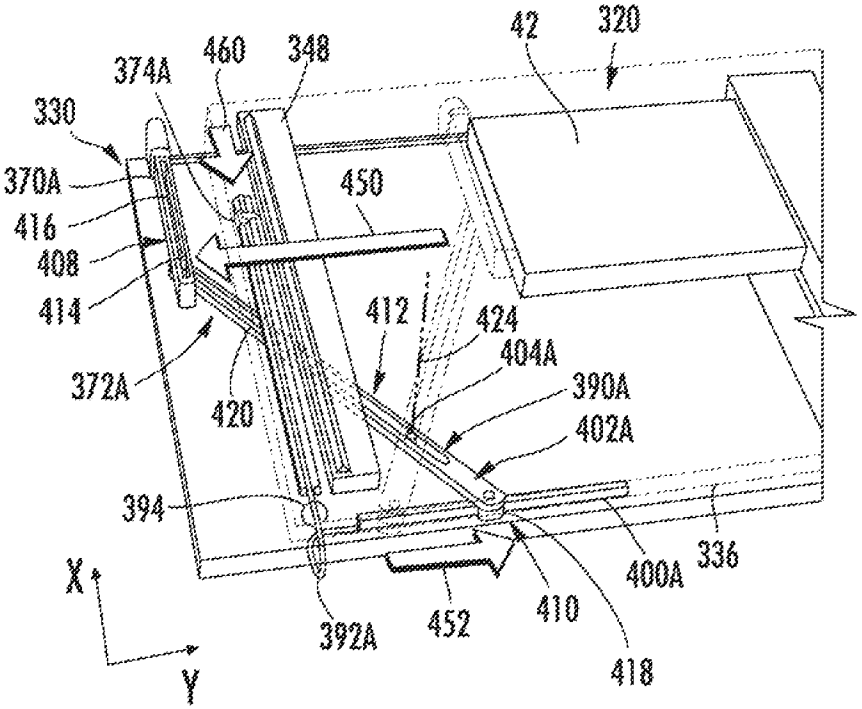
FIG. 7 is a top perspective view of the media handling system of FIG. 6 illustrating two positions of a first adjuster and a first gauge according to an example embodiment.

In tray media sensing system 330 is configured to sense or detect one or more dimensions of media while such media is supported by tray 336 and prior to any movement of such media from tray 336 towards interaction device 324. System 330 includes sliders, markers or adjusters 370A, 370B (collectively referred to as adjusters 370), couplers 372A, 372B (collectively referred to as couplers 72), gauges 374A, 374B (collectively referred to as gauges 374) and image sensor 348. As shown by FIGS. 6-8, adjusters 370 comprise structures configured to be selectively positioned at different positions along tray 336 to indicate the edges or dimensions of the media 42. In other embodiments, adjusters 370 may alternatively be configured to be selectively positioned at different positions along tray 336 corresponding to those portions of media 342 that are to be interacted upon. For example, if only the bottom half of one or more sheets 42 are to be printed upon, hole punched or the like, adjusters 370 may alternatively be positioned at a midpoint of sheets 42.

In the embodiment illustrated, adjusters 370 comprise linear or straight paddles or bars having side edges configured to abut edges of sheets 42 of media. Adjusters 370 are configured to be manually positioned by a person at desired locations along tray 336. As shown by FIG. 6, adjusters 370 extend from guides 375 at least partially across a top of tray 336 so as to abut side edges of sheets 42. In still other embodiments, one or both of adjusters 70A, 70B may alternatively extend substantially across an entire associated dimension of tray 36.

As shown by FIG. 6, adjusters 370A and 370B are movably and slidably supported and guided along a top of tray 336 by guides 375A and 375B (collectively referred to as guides 375), respectively. Guides 375 comprise rails, tracks, channels or projections. In one embodiment, guides 375 comprise channels that receive and slid ably interlock with a corresponding projections associated with each of adjusters 370. In another embodiment, guides 375 comprise elongate projections that are captured within corresponding grooves or channels, wherein adjusters 375 slide along such projections. Another embodiment, adjusters 370 may have other configurations and may be movably supported relative to tray 336 in other manners.

Couplers 372 comprise mechanisms operably coupling adjusters 370 to gauges 374 such that movement of adjusters 370 also results in movement of gauges 374. In the example illustrated, coupler 372A couples adjuster 370A to gauge 374A such that movement of adjuster 370A also results in movement of gauge 374A. Likewise, coupler 372B couples adjuster 370B to gauge 374B such that movement of adjuster 370B also results in movement of gauge 374B. As shown by FIGS. 7 and 8, each of couplers 372A, 372B include reduction mechanisms 390A, 390B (collectively referred to as reduction mechanisms 390), motion transmitters 392A, 392B (collectively referred to as motion transmitters 392) and guides 394A, 394B (collectively referred to as guides 394).

Reduction mechanisms 390 comprise arrangements or mechanisms located between adjusters 370 and gauges 374 that are configured to proportionately reduce the distance moved by gauges 370 in response to movement of adjusters 370. In other words, reduction mechanisms 390 result in gauges 374 proportionally moving relative to adjusters 370 at a rate of less than one. As shown by FIGS. 7 and 8, reduction mechanism 390A (shown in FIG. 7) and 390B (shown in FIG. 8) comprise linkage guides 400A, 400B (collectively referred to as linkage guides 400), linkages 402A, 402B (collectively referred to as linkages 402) and pivot pins 404A, 404B (collectively referred to as pivot pins 404), respectively.

Linkage guides 400 comprise rails, tracks or other structures configured to guide linear movement of an associated one of linkages 402. As shown in FIG. 7, linkage guide 400A extends along the Y-axis. As shown by FIG. 8, linkage guide 400B extends along the X-axis.

Linkages 402 each comprise one or more linkages or members operably coupled between adjusters 370 and motion transmitters 392 to transmit motion therebetween. As shown by FIG. 7, linkage 402A has a first end 408 pivotably and slidably connected to adjuster 370A, a second end 410 pivotably and slidably connected to guide 400A and a central portion 412 pivotably and slidably connected to pivot pin 404A. In the example illustrated, first end 408 includes a linkage pin 414 slidably and pivotably received within an elongate slot 416 extending along the adjuster 370. End 410 of linkage 402A is pivotably connected to a slider 418 that slides along rail 400A. Central portion 412 comprises an elongate slot 420 which at least partially receives pivot pin 404A which is static and fixed to tray 336. Pivot pin 404A facilitates pivoting of linkage 402A about axis 424.

As shown by FIG. 8, linkage 402B has a first portion 428 pivotably connected to adjuster 370B, a second portion 430 pivotably and slidably connected to pivot pin 404B and a intermediate portion 432 between portion 428 and portion 430 that is pivotably and slidably connected to guide 400B. In the example illustrated, portion 428 includes a linkage pin 434 about which linkage 402B pivots with respect to adjuster 370B. Portion 430 of linkage 402B is pivotably and slidably connected to pivot pin 444. Portion 430 includes an elongate slot which at least partially receives pivot pin 404B which is static and fixed to tray 336. Pivot pin 404B acilitates pivoting of linkage 402B about axis 444. Portion 430 is pivotably connected to slider 438 which slides along guide 400B.

Flexible motion transmitters 392 comprise elongate flexible members operably coupled between adjusters 370 and gauges 374 that are configured to transmit movement or motion while stilt being flexible, in particular, each of motion transmitters 392 is substantially incompressible or unstretchable along its axial centerline, yet is a flexible, bendable or deformable in directions non-parallel to its axial centerline without substantial debilitating damage or degradation. Because each of motion transmitters 392 is flexible, each of motion transmitters 392 may extend along a non-linear path, such as a bending, a curved, angled or a serpentine path between an associated adjuster 370 and an associated gauge 374. As a result, motion transmitters 392 may extend in a variety of different travel paths, increasing freedom and flexibility in the architecture of system 320. Because motion transmitters 392 are flexible, adjusters 370 and gauges 374 may be provided at distinct vertical levels or positions along the Z-axis of system 320. For example, adjuster 370 is located below base 356 while gauges 374 are generally above base 356. In other embodiment, adjusters 370 and gauges 374 may be at other distinct locations through the use of motion transmitters 392.

In the example illustrated, each of couplers 372 includes a flexible push rod (also known as a flexible push-pull rod) through which motion is transferred. In one embodiment, each of the flexible pushrods may be formed from dual strand bronzed steel cable. In such in embodiment, the flexible pushrods of couplers 372 have a diameter of $1/16^{th}$ of an inch. With such an embodiment form having the noted dimensions, the pushrod is sufficiently strong to transmit force and movement from adjusters 370 to gauges 374. In other embodiments, depending upon the expected forces, amount of guidance and support provided for coupler 372, and the length or distance over which motion must be transferred, the one or more materials chosen for couplers 372 and the dimensions of each of couplers 372 may be varied.

Guides 394 (schematically illustrated) comprise channels, bores, tracks or elongate continuous or intermittent structures which direct sliding movement of motion transmitters 392 along a controlled or defined non-linear path. Guides 394 may be formed in the frame or housing (not shown) of system 320 as well as along portions of tray 336 and base 356. For example, in one embodiment, guides 394 may comprise C-shaped channels continuous or spaced and intermittent) formed along tray 336 and base 356 which surround greater than 180 degrees of a cylindrical and flexible pushrod of motion transmitters 392 to capture end contain the pushrod while permitting a pushrod to slide through the central opening of the C-shaped channel. In other embodiments, such guides 94 may have other configurations.

Figure 10:
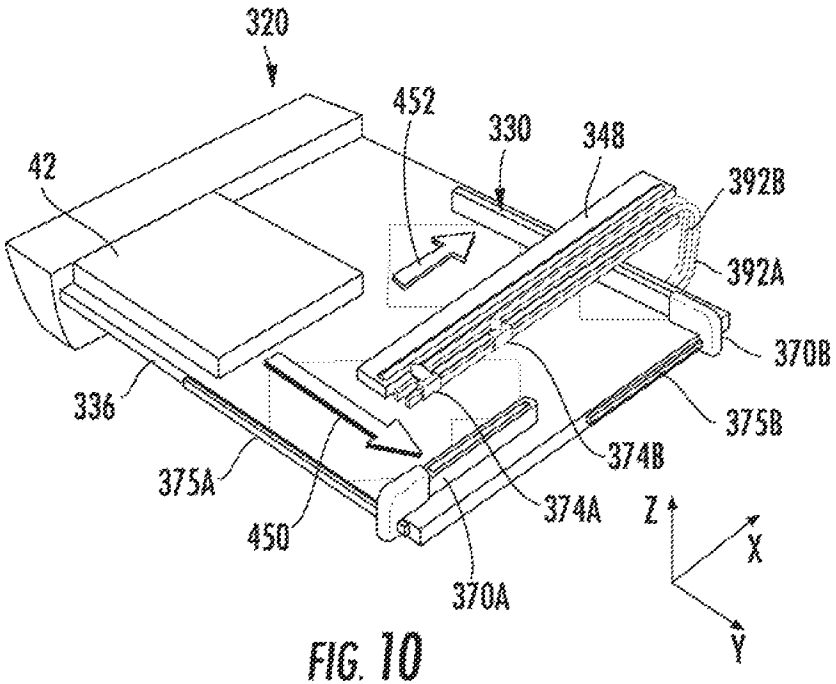
FIG. 10 is a top perspective view of the system of FIG. 6 illustrating adjusters and gauges at second positions according to an example embodiment.
Figure 9:
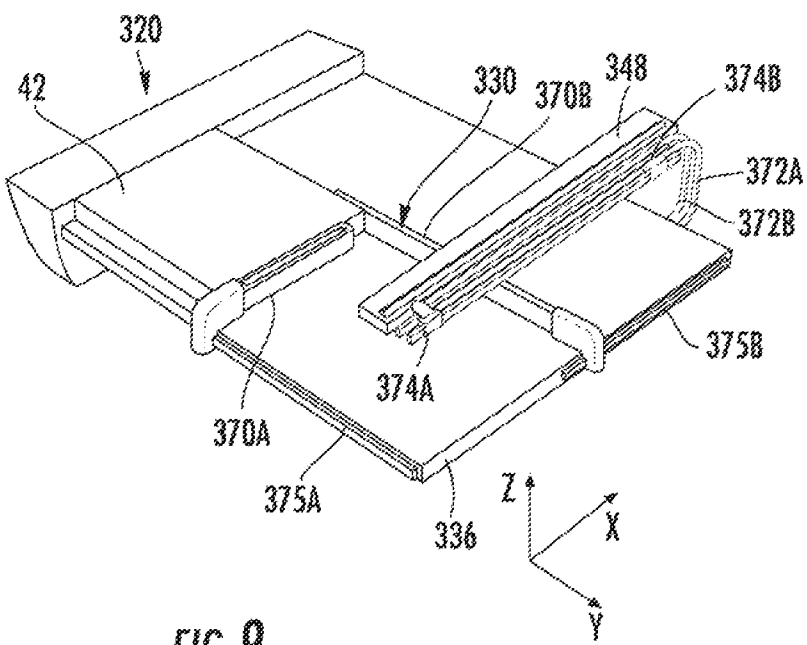
FIG. 9 is a top perspective view of the system of FIG. 6 illustrating adjusters and gauges at first positions according to an example embodiment.

Gauges 374 comprise structures operably coupled to adjusters 370 and configured to move in response to adjuster 370. Gauges 374 are further configured to define points or edges corresponding to dimensions of sheets 342 based upon their positions. Gauges 374 are configured to be sensed by image sensor 348. As shown by FIGS. 6A, 9 and 10, gauges 374 project into the optical viewing range 435 of image sensor 348 and move along a single axis or along different but parallel axes in response to movement of adjusters 370. As shown by FIG. 6A, gauges 374A, 374B slidably move along a pair of parallel guides 437A, 437B, respectively, and include pointers 439 which project over viewing range 435. In other embodiment, both gauges 374 are supported by a single guide (shown as a rail or track). Although guides 437 are illustrated as being connected to or supported by tray 336, in other embodiments, guides for 30 may be supported by other structures.

In the example illustrated, gauges 374 move along at a single X-axis. Flexible motion transmitters 392 facilitate positioning and movement of gauges 374 along a single axis or along parallel axes. Because gauges 374 move along a single axis or along parallel axes, gauges 374 may be more closely located with respect to one another and the sensing of the positioning of gauges 374 may be more easily achieved with little or no movement of imaging sensor 348. In the example illustrated, the positioning of both the gauges 374 may be detected by image sensor 348 using one or more of the sensing elements white image sensor 348 is substantially stationary or parked. In other embodiments, gauge 374A and gauge 374B may alternatively move along distinct non-parallel axes. In such an embodiment, image sensor 348 may be moved to sense the positioning of both gauges or additional sensors may be employed to set the positioning of one or both of the gauges 374.

FIGS. 7-13 further illustrate, in more detail, movement of gauges 374 in response to movement of adjusters 370. FIG. 9 illustrates adjusters 370 at first positions in which adjusters 370 butt against edges of sheet to 42 having a first width and a first length. FIG. 10 illustrates adjusters 370 moved in the directions indicated by arrows 450 and 452 to second positions generally representing the largest range of media dimensions that may be accommodated by tray 336. As shown by FIG. 7, movement of adjuster 370A from the first position (shown in broken lines) to the second position (shown in solid lines) in the direction indicated by arrow 450 by a distance $L_a$ results in linkage 402A pivoting about pivot pin 404A in a counter clockwise direction (CSC and FIG. 7) which results in end 410 of linkage 402A sliding along rail 400A in the direction indicated by arrow 452 by a distance $L_s$. Distance $L_s$ is proportional to distance $L_a$ by a predetermined ratio of less than one. In particular, the ratio $L_s/L_a$ is equal to the ratio $d_1/d_2$, wherein distance $d_1$ is the distance between guide 400A and pivot pin 404A and wherein distance $d_2$ is a distance between pivot pin 404A and linkage pin 414. As a result, motion transmitter 392A which is connected to slider 418 (or to any portion of linkage 402A between pivot pin 404A and slider 418) is pulled in the direction indicated by arrow 460 to move gauge 374A in the direction indicated by arrow 462 in FIG. 11 from the first position (shown in broken lines) to the second position (shown in solid lines). Movement of adjuster 370A in an opposite direction similarly results in movement of gauge 374A in the opposite direction.

As shown by FIG. 8, movement of adjuster 370B from the first position (shown in broken lines to the second position (shown in solid lines) in the direction indicated by arrow 470 by a distance $W_a$ results in linkage 402B pivoting about pivot pin 404B in a counter-clockwise direction (as seen in FIG. 8) which results in portion 432 of linkage 402B sliding along rail 400B also in the direction indicated by arrow 470 by a distance $W_s$. Distance $W_s$ is proportional to distance $W_a$ by a predetermined ratio of less than one. In particular, the ratio $W_s$/NV, is equal to the ratio $D_1/D_2$, wherein distance $D_1$ is the distance between guide 400B and guide 375B and wherein distance $D_2$ is a distance between pivot pin 404B and guide 400B. As a result, motion transmitter 392B which is connected to slider 432 is pushed in the direction indicated by arrow 480 to move gauge 374B in the direction indicated by arrow 482 in FIGS. 8 and 12 from the first position (shown in broken lines) to the second position (shown in solid lines). Movement of adjuster 370B in an opposite direction similarly results in movement of gauge 37413 in the opposite direction.

FIG. 13 is a top plan view illustrating movement of gauges 374 along the optical viewing range 435 of the scan bar of image sensor 348. In particular, FIG. 13 illustrates movement of gauge 374A from the first position (shown in broken lines) corresponding to the minimum media length position of adjuster 370A (shown in FIG. 9) to a second position (shown in solid lines) corresponding to the maximum media length position of adjuster 370A (shown in FIG. 10). Likewise, FIG. 13 also illustrates movement of gauge 374B from the first position shown in broken lines) corresponding to the minimum media length position of adjuster 370B (shown in FIG. 9) to a second position (shown in solid lines) corresponding to the maximum media length position of adjuster 370B (shown in FIG. 10).

Display 332 and controller 334 are similar to display 32 and controller 34 described above with respect to system 20. Display 332 comprise a device configured to present information to one or more persons regarding the sensor detected dimensions of sheets 42 by the in tray media sensing system 30. Display 332 may also be configured to present instruction and/or choices or options for the user to select based upon the presented dimension information. In the embodiment illustrated, display 332 may comprise a display screen including buttons and/or a touch screen for facilitating entry of commands or instructions from a user or operator. In another embodiment, display 332 may comprise rows of lights, such as rows of tight emitting diodes (LEDs) representing different dimensions. In yet other embodiments, display 332 may comprise an audible display providing sounds or synthesized words communicating the sensed dimensions. In other embodiments, display 32 may be omitted.

Controller 334 comprises one or more processing units configured to generate control signals based at least in part upon signals received from image sensor 348 (or other sensors) which represent the positioning of gauges 374 which correspond to positioning of adjusters 370. In the particular example illustrated, controller 334 receives signals from image sensor 348 which correspond to dimensions of sheets 42 upon tray 336. Based upon such signals, controller 334 consults a lookup table stored in memory, applies an algorithm, or otherwise determines the actual dimensions of sheets 42 upon tray 336. In one embodiment, controller 334 generates a control signal directing display 332 to present the detected and determined dimensions of sheets 42 to a user. In one embodiment, controller 334 may additionally generate a control signal directing display 330 to provide the user or person with options or instructions based upon such detected dimensions. In one embodiment, controller 334 may also generate control signals which vary or adjust operation of the media picked device 338 and/or interaction device 324 based upon the determined dimensions of sheets 42 within tray 336. For example, for a given set of sheet dimensions, controller 334 may adjust the speed, torque or compressive force applied by media pick device 38 (shown in FIG. 1) or media drivers of media path 40 (shown in FIG. 1). In particular, a certain dimension may indicate that a stiffer media has been loaded upon tray 336 or a particular media type (photo media) has been loaded upon tray 336. Controller 334 may adjust operational parameters to best accommodate such media.

Based upon the determined media size or dimensions, controller 334 may also vary the operation of interaction device 324. For example, in embodiments where interaction device 324 comprises a print device, controller 334 may adjust the extent (surface area) to which interaction device 24 prints upon sheet 42. The resolution, quality, density or type of ink or toner being applied may also be determined or controlled based upon the determined dimensions of sheet 42 or media quality generally associated with a particular media size.

Figure 5:
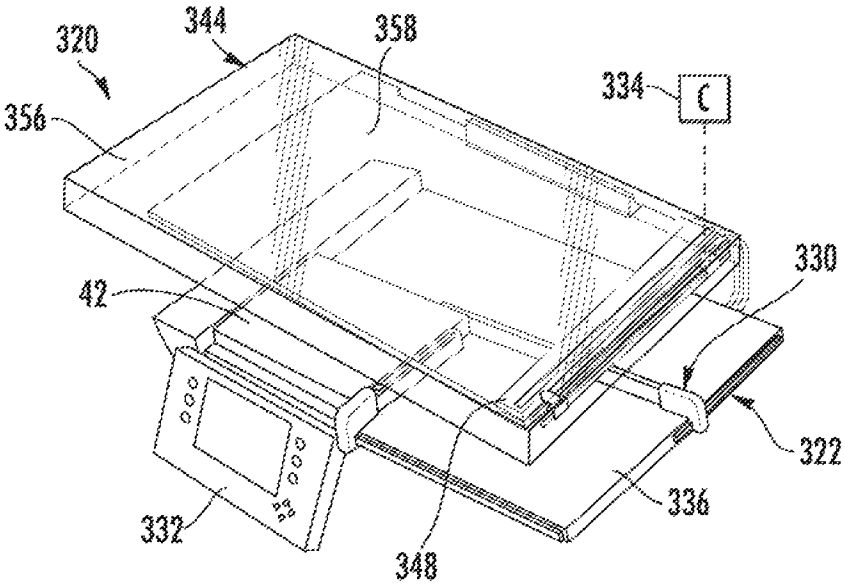
FIG. 5 is a top perspective view of portions of the media handling system of FIG. 4 according to an example embodiment.
Figure 4:
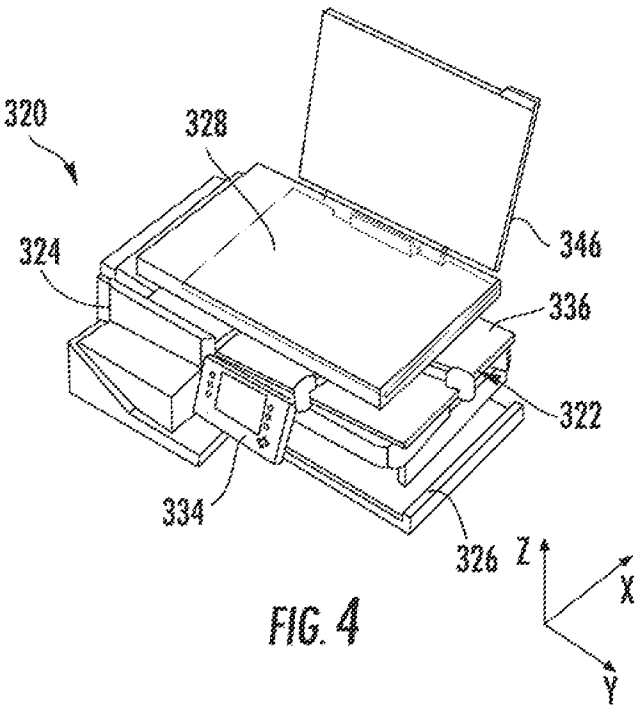
FIG. 4 is a top perspective view of another embodiment of the media handling system of FIG. 1 according to an example embodiment.
Figure 14:
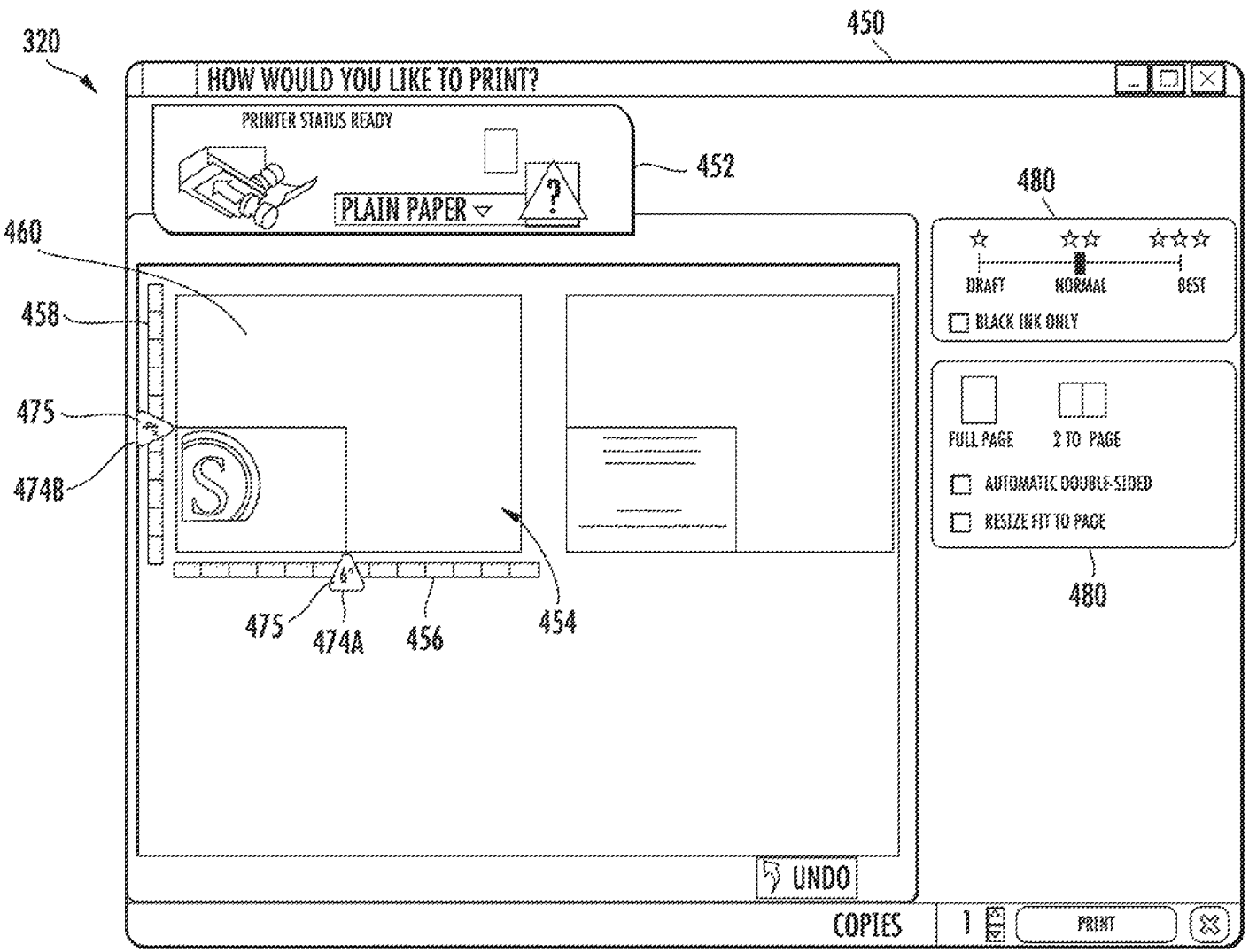
FIG. 14 is a front elevational view of a display representation of the system of FIG. 4 according to an example embodiment.

FIG. 14 illustrates one example of information that may be provided by controller 334 using display 332 and based upon the determined dimensions of sheets 42 while sheets 42 are within tray 336 (shown in FIG. 5). In particular, FIG. 14 illustrates one example display screen or presentation 450 that may be provided by controller 334. As shown by display portion 452 of presentation 450, graphics instructing a person how to move adjusters 70 are provided. As shown by display portion 454, rulers 456 and 458 are provided along with a graphical representation 460 representing tray 336 or the maximum dimensions of sheets that may be placed upon tray 336. In addition, gauge icons 474A and 474B (collectively referred to as icons 474) are graphically presented. In one embodiment, movement of adjusters 370 (shown in FIG. 5 results in proportional movement of icons 474 along rulers 456, 458 in real time (concurrently with movement of adjusters or 370 and gauges 374). As shown in FIG. 14, in one embodiment, measurement values 475 are presented on such icons 474 and are concurrently updated with new measurement values as icons 474 are moved along rulers 456, 458 and as the actual adjusters 370 and gauges 374 are being moved. As a result, a person is presented with graphical real-time information regarding the dimensions of sheets 42 within tray 336. As shown by portions 480 presentation 450, additional instructions or options may also be presented to a person by controller 334.

Although the present disclosure has been described with reference to example embodiments, workers skilled in the an will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a media tray;

a first adjuster alignable with a first surface of media on the tray;

a first gauge operably coupled to the adjuster so as to move in response to movement of the adjuster; and an image sensor configured to sense the first gauge and to sense images on the media.

2. The apparatus of claim 1, further comprising:

a second adjuster alignable with a second surface of the media on the tray; and a second gauge operably coupled to the second adjuster so as to move in response to movement of the second adjuster.

3. The apparatus of claim 2, wherein the image sensor is configured to sense both the first gauge and a second gauge.

4. The apparatus of claim 2, wherein the first gauge and the second gauge move along a single axis or parallel axes.

5. The apparatus of claim 4, wherein the first adjuster and the second adjuster move along perpendicular axes.

6. The apparatus of claim 1, further comprising a scanning bed, wherein the image sensor is movable at least partially across the scanning bed.

7. The apparatus of claim 1, further comprising a print device configured to print upon media supplied from the media tray.

8. The apparatus of claim 7, wherein the image sensor is configured to sense images upon media supplied from the tray.

9. The apparatus of claim 1, wherein the image sensor is configured to sense images upon media supplied from the tray.

10. The apparatus of claim 1, wherein the first gauge moves proportionally relative to movement of the adjuster at a rate of less than one.

11. The apparatus of claim 1, wherein the first adjuster moves along a first axis and wherein the first gauge moves along a second axis perpendicular to the first axis.

12. The apparatus of claim 1, wherein the first gauge is operably coupled to the adjuster by a flexible pushrod.

13. The apparatus of claim 1, further comprising:

a dimension display; and a controller coupled to the image sensor, wherein the controller is configured to generate control signals based upon detection of the first gauge by the image sensor and wherein the dimension display indicates a dimension of the medium in the tray in response to the control signals.

14. The apparatus of claim 1, further comprising a controller coupled to the image sensor, wherein the controller is configured to process images on media captured by the image sensor based upon signals representing positioning of the first gauge.

15. The apparatus of claim 1, wherein the image sensor is configured to move at least partially across and opposite to media and wherein the apparatus further comprises a controller coupled to the image sensor and configured to generate control signals based upon signals from the image sensor representing positioning of the first gauge to control movement of the sensor.

16. The apparatus of claim 1, further comprising:

a print device; and a controller coupled to the image sensor and configured to generate control signals based upon signals from the image sensor representing detection of the first gauge, wherein printing on the media by the print device is based at least in part upon the control signals.

17. A method comprising:

aligning an adjuster with an edge of media on a tray, the adjuster being operably coupled to a gauge that moves in response to movement of the adjuster;

sensing the gauge with an image sensor configured to sense images on media;

moving media from the tray; and interacting with the media based upon the sensing of the gauge.

18. An apparatus comprising:

a media tray;

an adjuster alignable with the edge of media supported on the media tray;

a gauge operably coupled to the adjuster by a flexible pushrod; and a sensor configured to sense the gauge.

* * * * *